US009291312B2

(12) United States Patent
Pan et al.

(10) Patent No.: US 9,291,312 B2
(45) Date of Patent: Mar. 22, 2016

(54) LED TUBE HAVING LONG INTERNAL CREEPAGE DISTANCES

(71) Applicant: LUXUL TECHNOLOGY INCORPORATION, New Taipei (TW)

(72) Inventors: Cheng-Hung Pan, New Taipei (TW); Yung-Ta Hung, New Taipei (TW); Cheng-Hsien Chen, New Taipei (TW)

(73) Assignee: LUXUL TECHNOLOGY INCORPORATION, New Taipei (TW)

( * ) Notice: Subject to any disclaimer, the term of this patent is extended or adjusted under 35 U.S.C. 154(b) by 157 days.

(21) Appl. No.: 14/166,591

(22) Filed: Jan. 28, 2014

(65) Prior Publication Data

US 2015/0049474 A1 Feb. 19, 2015

(30) Foreign Application Priority Data

Aug. 15, 2013 (TW) ..... 102129258 A

(51) Int. Cl.
*F21K 99/00* (2010.01)
*F21V 19/00* (2006.01)
*F21V 29/507* (2015.01)

(52) U.S. Cl.
CPC ..... *F21K 9/175* (2013.01); *F21V 19/0045* (2013.01); *F21V 29/507* (2015.01)

(58) Field of Classification Search
CPC ... F21V 19/0045; F21V 29/507; F21V 9/175; F21V 29/004
USPC ..... 362/218, 249.02, 294, 373
See application file for complete search history.

(56) References Cited

U.S. PATENT DOCUMENTS

| | | | | |
|---|---|---|---|---|
| 8,899,780 | B2 * | 12/2014 | Maxik et al. | 362/225 |
| 2012/0081891 | A1 * | 4/2012 | Tung et al. | 362/218 |
| 2015/0043205 | A1 * | 2/2015 | Wei | 362/223 |
| 2015/0049474 | A1 * | 2/2015 | Pan et al. | 362/218 |

* cited by examiner

*Primary Examiner* — Anabel Ton
(74) *Attorney, Agent, or Firm* — Muncy, Geissler, Olds & Lowe PC

(57) ABSTRACT

An LED tube has a tube body, an LED light board and two caps. The tube body has a translucent tube shell and a heat dissipating seat. The translucent tube shell has two openings and a gap. The heat dissipating seat is mounted in the gap. The LED light board is mounted in the tube body and has a luminous surface, wherein two opposite ends of the LED light board extend out of the heat dissipating seat. The luminous surface has four electrical connecting parts, wherein each two electrical connecting parts are respectively mounted near a corresponding one of the two opposite ends, thus, the four electrical connecting parts are mounted away from the heat dissipating seat to extend internal creepage distances between the four electrical connecting parts and the heat dissipating seat, and further increase electrical safety of the LED tube.

16 Claims, 19 Drawing Sheets

LED TUBE HAVING LONG INTERNAL CREEPAGE DISTANCES

BACKGROUND OF THE INVENTION

1. Field of the Invention

The present invention relates to a light emitting diode (LED) tube and more particularly to an LED tube having long internal creepage distances.

2. Description of Related Art

LEDs have features of small volume, high luminous efficiency and long service life. Thus, LED tubes using LEDs as light sources have become more and more common.

With reference to FIG. 18, a conventional LED tube has a heat dissipating seat 60, an LED light board 70, a translucent tube shell 80 and two caps 90.

The heat dissipating seat 60 is semi-cylindrical and has a rectangular flat surface, a convex surface, multiple fins 61 and two slide tracks 62. The rectangular flat surface has two opposite long sides and two opposite short sides. The multiple fins 61 are formed concave on the convex surface, and the two slide tracks 62 are respectively formed on the two long sides of the flat surface.

The LED light board 70 is rectangular and has two opposite long sides, two opposite short sides vertically connected to the two long sides, four electrical connecting parts 71 and multiple LED units 72. The two long sides of the LED light board 70 are slidably mounted in the two slide tracks 62 respectively. Thus, the LED light board 70 is mounted on the flat surface of the heat dissipating seat 60, and the two short sides of the LED light board 70 are respectively in alignment with the two short sides of the flat surface. Each two of the four electrical connecting parts 71 are mounted on the LED light board 70 and near a corresponding short side of the LED light board 70. The multiple LED units 72 are mounted at intervals on the LED light board 70 in a longitudinal direction of the LED light board 70.

The translucent tube shell 80 is semi-cylindrical and is connected to the heat dissipating seat 60 to form a tube body, wherein the translucent tube shell 80 faces the multiple LED units 72 of the LED light board 70.

Each cap 90 is sleeved on a corresponding end of the tube body and has two electrode pins 91 respectively and electrically connected to two of the electrical connecting parts 71 that are adjacent to the corresponding end.

When the LED tube is mounted in a lamp holder and is switched on, the LED light board 70 obtains power through the four electrode pins 91 of the two caps 90 and glows by the multiple LED units 72. Heat produced by the functioning LED light board 70 is conducted to the heat dissipating seat 60 and further dissipated by the multiple fins 61.

With reference to FIG. 19, the two opposite short sides of the LED light board 70 are aligned with the heat dissipating seat 60, wherein the electrical connecting parts 71 are mounted near the short sides of the LED light board 70, that is, the electrical connecting parts 71 are mounted near the heat dissipating seat 60. Besides, the electrical connecting parts 71 are also mounted near the two slide tracks 62. The electrical connecting parts 71 are electrically conductive elements, and the heat dissipating seat 60 and the two slide tracks 62 are both made of metal, which is highly conductive. A creepage distance d1 between the electrical connecting part 71 and the two slide tracks 62 is relatively short. When the LED tube functions, the electrical connecting parts 71 obtain a high voltage power from the caps 90. A surface of the LED light board 70 around the electrical connecting parts 71 may be electrically polarized due to the high voltage power obtained by the electrical connecting parts 71. The electrical connecting parts 71 and the slide tracks 62 may be conducted through the polarized surface causing short-circuit between the electrical connecting parts 71 and the slide tracks 62 damaging the LED tube.

Furthermore, each cap 90 is only sleeved on a corresponding end of the tube body consisting of the heat dissipating seat 60 and the translucent tube shell 80, that is, a connection between each cap 90 and the tube body is not stable. When an unexpected force is applied on the LED tube, the caps 90 are to rotate easily and cause a deviation of the illumination angle of the LED tube.

SUMMARY OF THE INVENTION

The main objective of the invention is to provide an LED tube having long internal creepage distances.

The LED tube comprises a tube body, an LED light board and two caps. The tube body has a translucent tube shell and a heat dissipating seat. The translucent tube shell has two openings, a gap formed through the translucent tube shell along a longitudinal direction of the translucent tube shell, and two side walls separated by the gap. The heat dissipating seat is mounted in the gap. The LED light board is mounted in the tube body and has two opposite sides, two opposite ends, a back surface and a luminous surface opposite to the back surface, wherein a length of the LED light board in a longitudinal direction of the LED light board is longer than a length of the heat dissipating seat in a longitudinal direction of the heat dissipating seat. The two ends of the LED light board are connected to the two sides of the LED light board, wherein the two ends of the LED light board extend out of the heat dissipating seat. The luminous surface faces toward the translucent tube shell and has four electrical connecting parts mounted on the luminous surface, wherein each two electrical connecting parts are mounted near a corresponding one of the two ends of the LED light board. The back surface abuts the heat dissipating seat. The two caps are respectively mounted on the two openings of the translucent tube shell, wherein each cap has two electrically and respectively connected to a corresponding one of the electrical connecting parts of the LED light board.

The two ends of the LED light board both extend out of the heat dissipating seat and the two electrical connecting parts are respectively mounted near the two ends, that is, the two electrical connecting parts are mounted away from the heat dissipating seat to extend creepage distances between the two electrical connecting parts and the heat dissipating seat, and electrical safety of the LED tube in accordance with the present invention is improved.

Another objective of the invention is to provide an LED tube having caps firmly mounted on the LED tube.

The heat dissipating seat further comprises a top surface and a bottom surface. The bottom surface has multiple fins and two semi-annular grooves. The multiple fins are formed on the bottom surface and extend downward from the bottom surface. The two semi-annular grooves are respectively formed on two adjacent fins of the multiple fins and face each other. Each cap further comprises a screw having a screw head and a screw rod. The screw rod is mounted through the cap and between the two semi-annular grooves of the heat dissipating seat, and the screw head abuts the cap to screw the cap on a corresponding one of the two openings of the translucent tube shell.

In conclusion, the two caps are firmly mounted on the openings of the translucent tube shell via the two semi-annular grooves of the heat dissipating seat and the screws of the two caps.

DETAILED DESCRIPTION OF THE PREFERRED EMBODIMENTS

Figure 1:
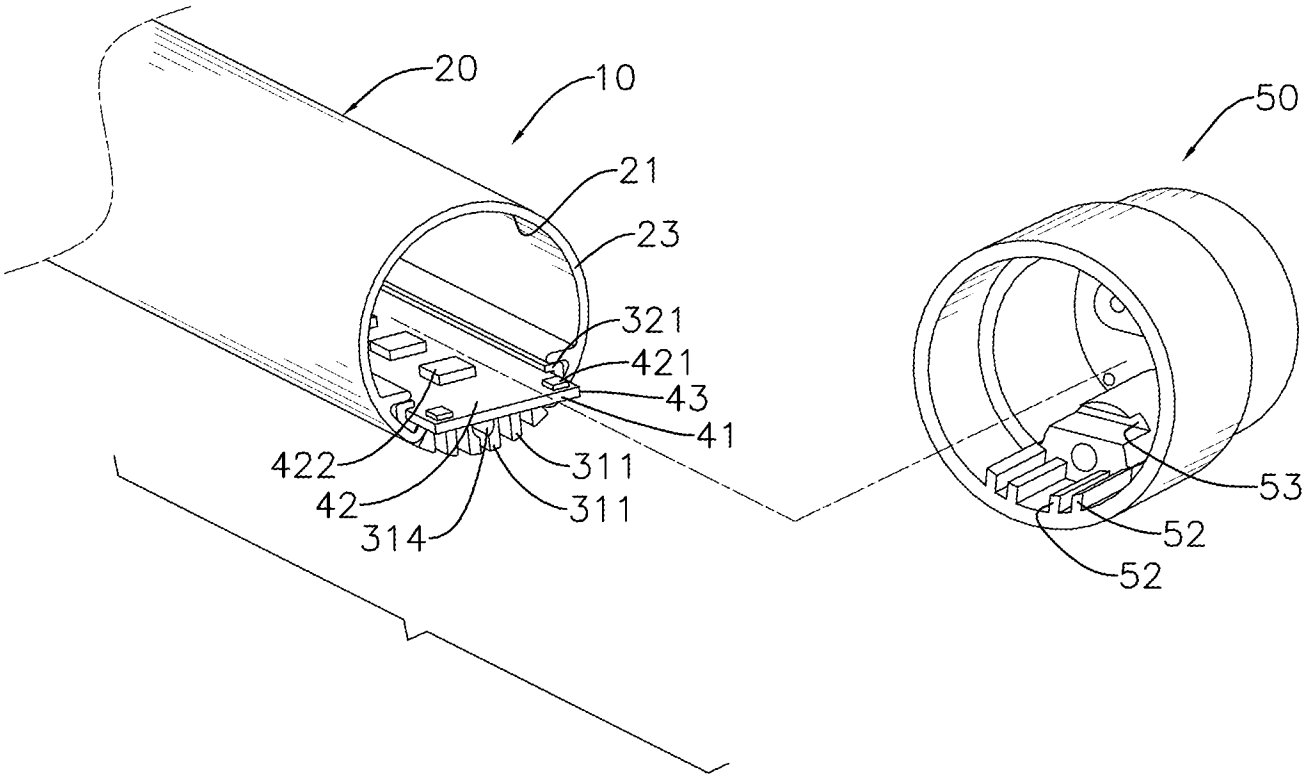
FIG. 1 is a partial exploded view of a first embodiment of an LED tube in accordance with the present invention.
Figure 2:
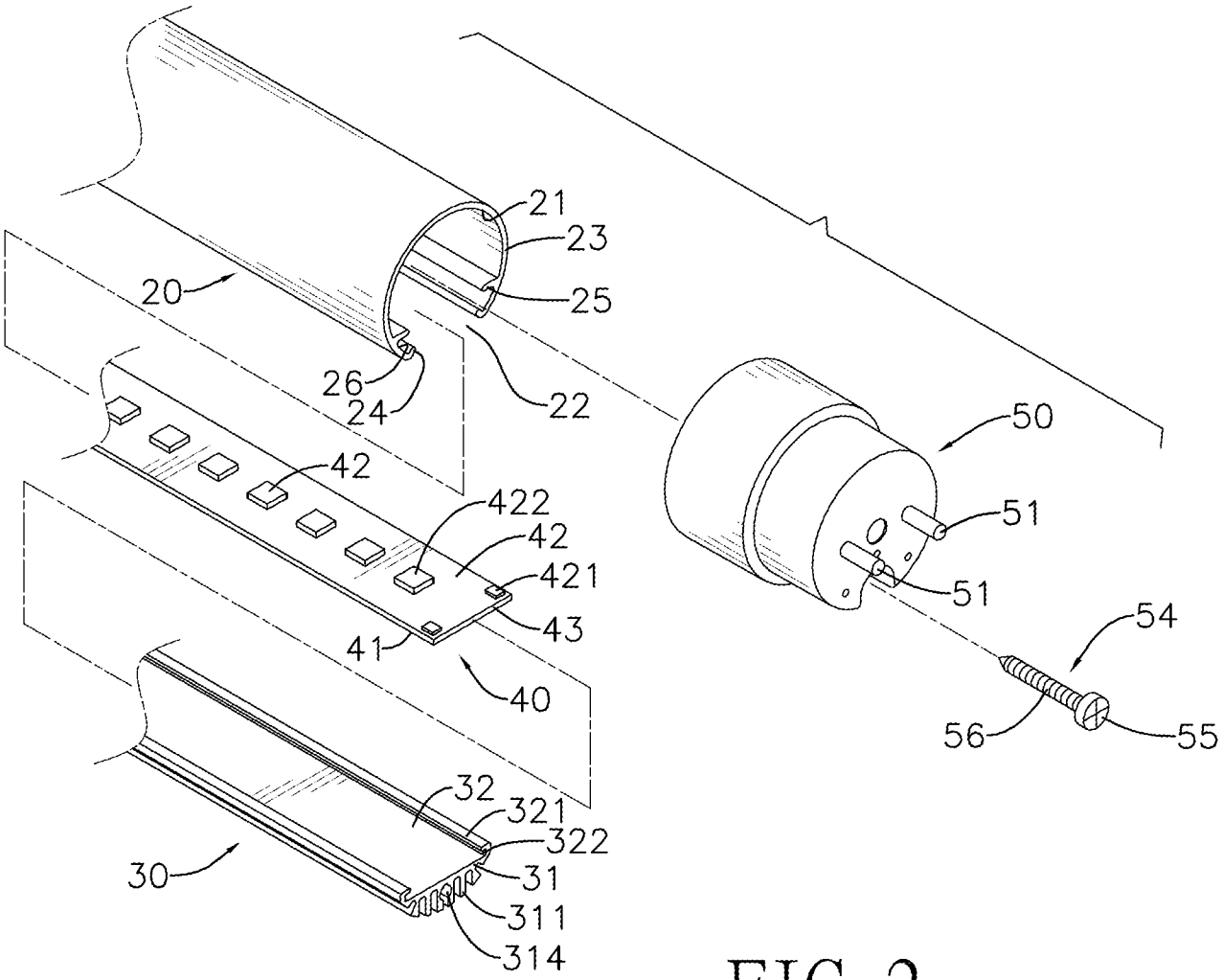
FIG. 2 is an exploded view of the LED tube in FIG. 1.
Figure 3:
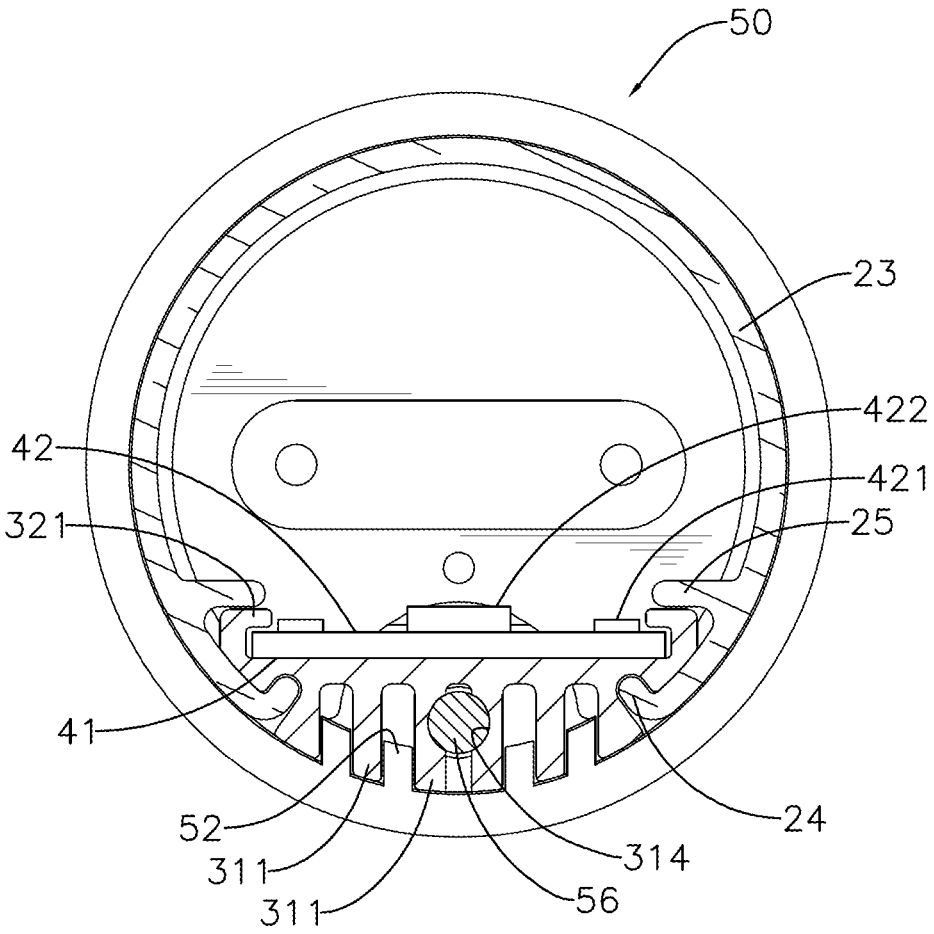
FIG. 3 is a side view in cross section of the LED tube in FIG. 1.

With reference to FIGS. 1 to 3, a first embodiment of an LED tube in accordance with the present invention comprises a tube body 10, an LED light board 40 and two caps 50.

The tube body 10 comprises a translucent tube shell 20 and a heat dissipating seat 30.

The translucent tube shell 20 is electrically insulating and has two openings 21, a gap 22 and two side walls 23, two first ribs 24, two second ribs 25 and two first slide tracks 26. The gap 22 is formed through the translucent tube shell 20 along a longitudinal direction of the translucent tube shell 20. The two side walls 23 are separated by the gap 22. The two first ribs 24 are respectively formed on the two side walls 23 and adjacent to the gap 22. The two second ribs 25 are respectively formed on the two side walls 23, and respectively located above the two first ribs 24. Each first slide track 26 is formed between a corresponding one of the side walls 23, the first rib 24 formed on said corresponding side wall 23, and the second rib 25 formed on said corresponding side wall 23.

The heat dissipating seat 30 is mounted in the gap 22 of the translucent tube shell 20 and the heat dissipating seat 30 is made of metal. The heat dissipating seat 30 has two opposite sides in parallel to a longitudinal direction of the heat dissipating seat 30, a bottom surface 31 and a top surface 32 opposite to the bottom surface 31. The bottom surface 31 faces downward and has multiple fins 311 and two semi-annular grooves 314. The multiple fins 311 extend downward from the bottom surface 31. The two semi-annular grooves 314 are respectively formed on two adjacent fins 311 of the multiple fins 311 and face each other. The top surface 32 has two slide bars 321 and two slide tracks 322. The two slide bars 321 extend upward from the top surface 32 and respectively along the two opposite sides of the heat dissipating seat 30, wherein the two slide tracks 322 are respectively formed concave on the two slide bars 321 and face each other.

The LED light board 40 is mounted in the tube body 10 and has two opposite sides slidably mounted in the two slide tracks 322 respectively, two opposite ends 43 connected to the two opposite sides of the LED light board 40, a back surface 41, and a luminous surface 42 opposite to the back surface 41, wherein a length of the LED light board 40 in a longitudinal direction of the LED light board 40 is longer than a length of the heat dissipating seat 30 in the longitudinal direction of the heat dissipating seat 30. The two ends 43 are respectively near the two openings 21 of the translucent tube shell 20 and extend out of the heat dissipating seat 30. The back surface 41 abuts the top surface 32 of the heat dissipating seat 30. The luminous surface 42 has four electrical connecting parts 421 and multiple LED units 422. Each two electrical connecting parts 421 are mounted on the luminous surface 42 and near a corresponding one of the two opposite ends 43. The multiple LED units 422 are mounted at intervals on the luminous surface 42 along the longitudinal direction of the LED light board 40.

The caps 50 are respectively sleeved on the two openings 21 of the translucent tube shell 20. Each cap 50 has an inner wall, two electrode pins 51, multiple fin fixing parts 52 and a board fixing groove 53. The two electrode pins 51 are mounted through the cap 50 and electrically connected to two corresponding ones of the electrical connecting parts 421 respectively. The multiple fin fixing parts 52 are formed on the inner wall of the cap 50, wherein each fin fixing part 52 is mounted between two adjacent fins 311 of the multiple fins 311. The board fixing groove 53 is formed in the cap 50, wherein each end 43 of the LED light board 40 is mounted in a corresponding one of the board fixing grooves 53. Furthermore, with reference to FIGS. 2 and 3, each cap 50 further has a screw 54, wherein the screw 54 has a screw head 55 and a screw rod 56 connected to the screw head 55. The screw rod 56 is mounted through the cap 50 and between the two semi-annular grooves 314 of the heat dissipating seat 30, and the screw head 55 abuts the cap 50 to screw the cap 50 on a corresponding one of the openings 21 of the translucent tube shell 20.

Figure 4:
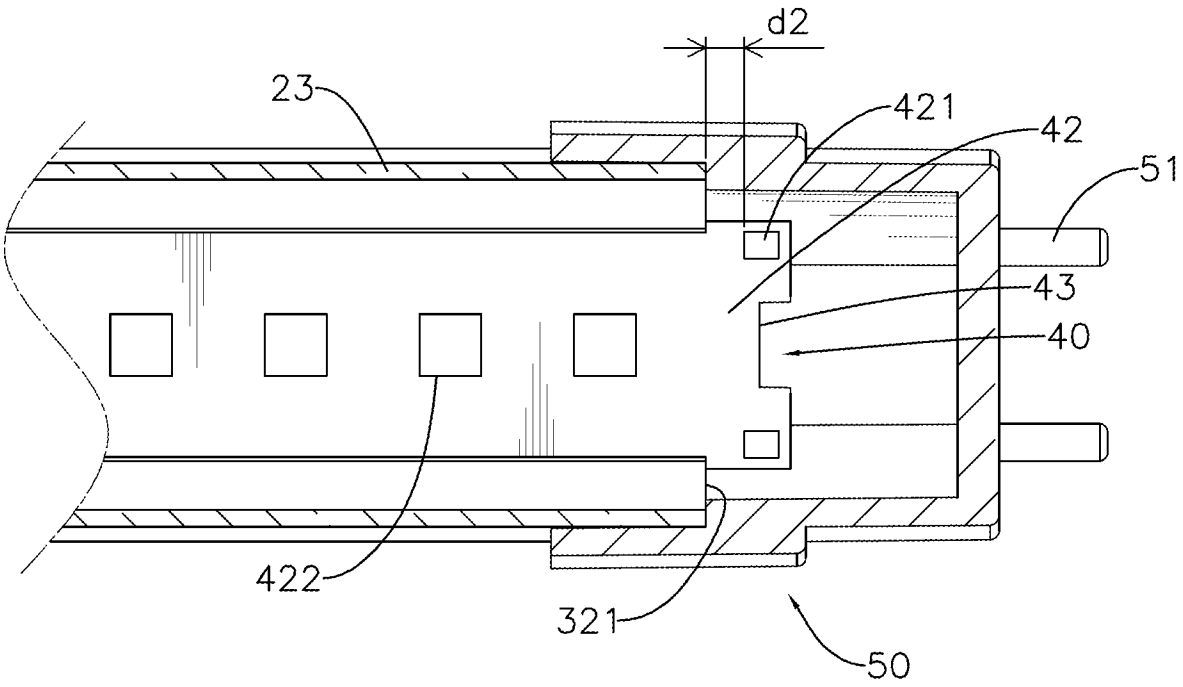
FIG. 4 is a top view in cross section of the LED tube in FIG. 1.
Figure 5:
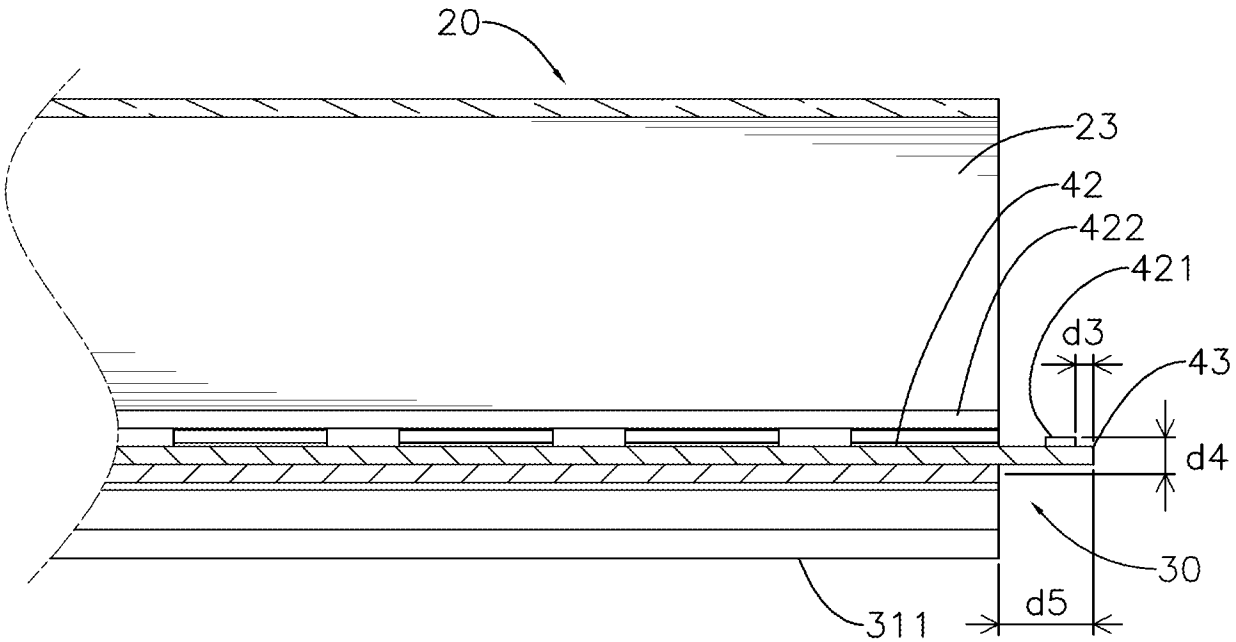
FIG. 5 is a front view in cross section of the LED tube in FIG. 1 without a cap.
Figure 6:
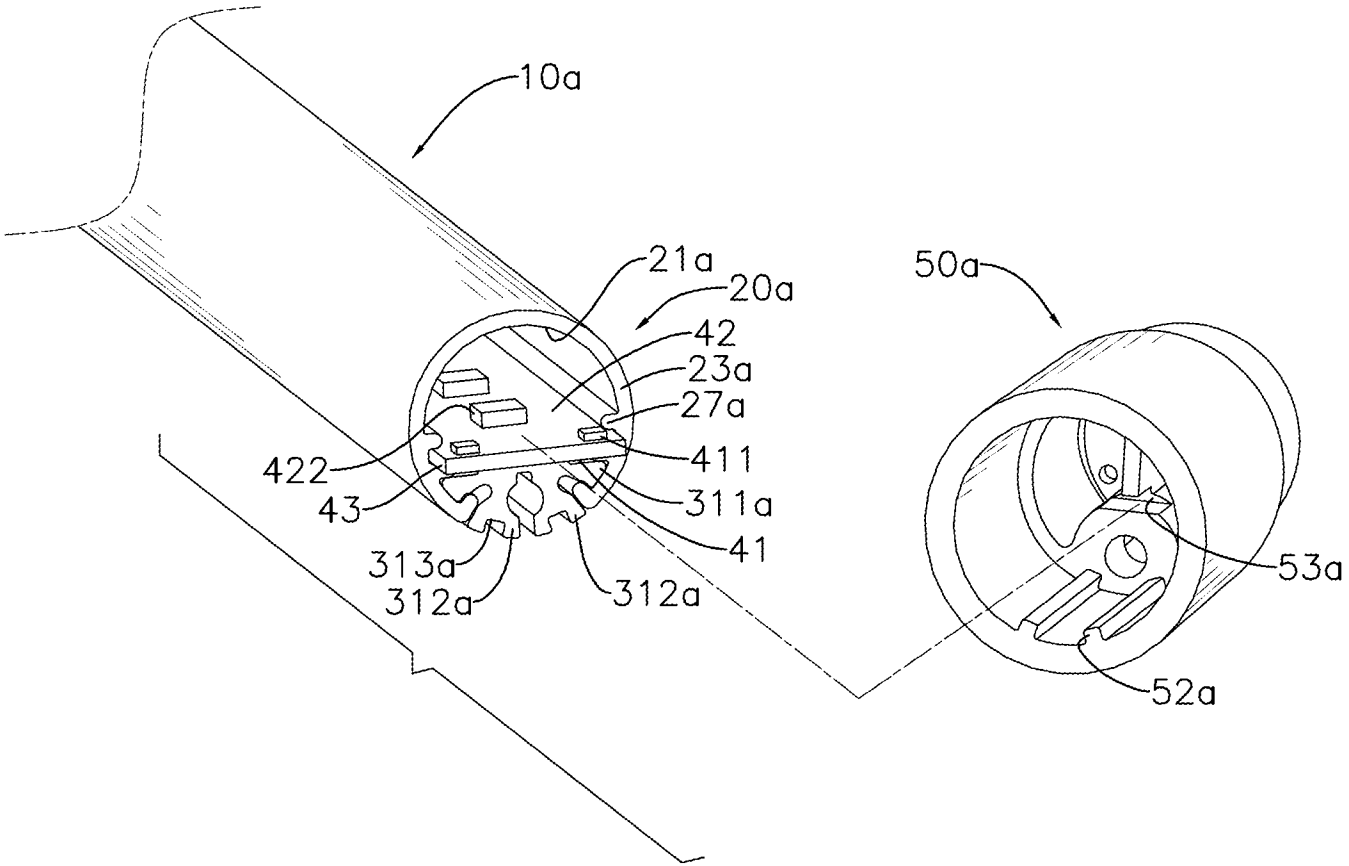
FIG. 6 is a partial exploded view of a second embodiment of an LED tube in accordance with the present invention.
Figure 7:
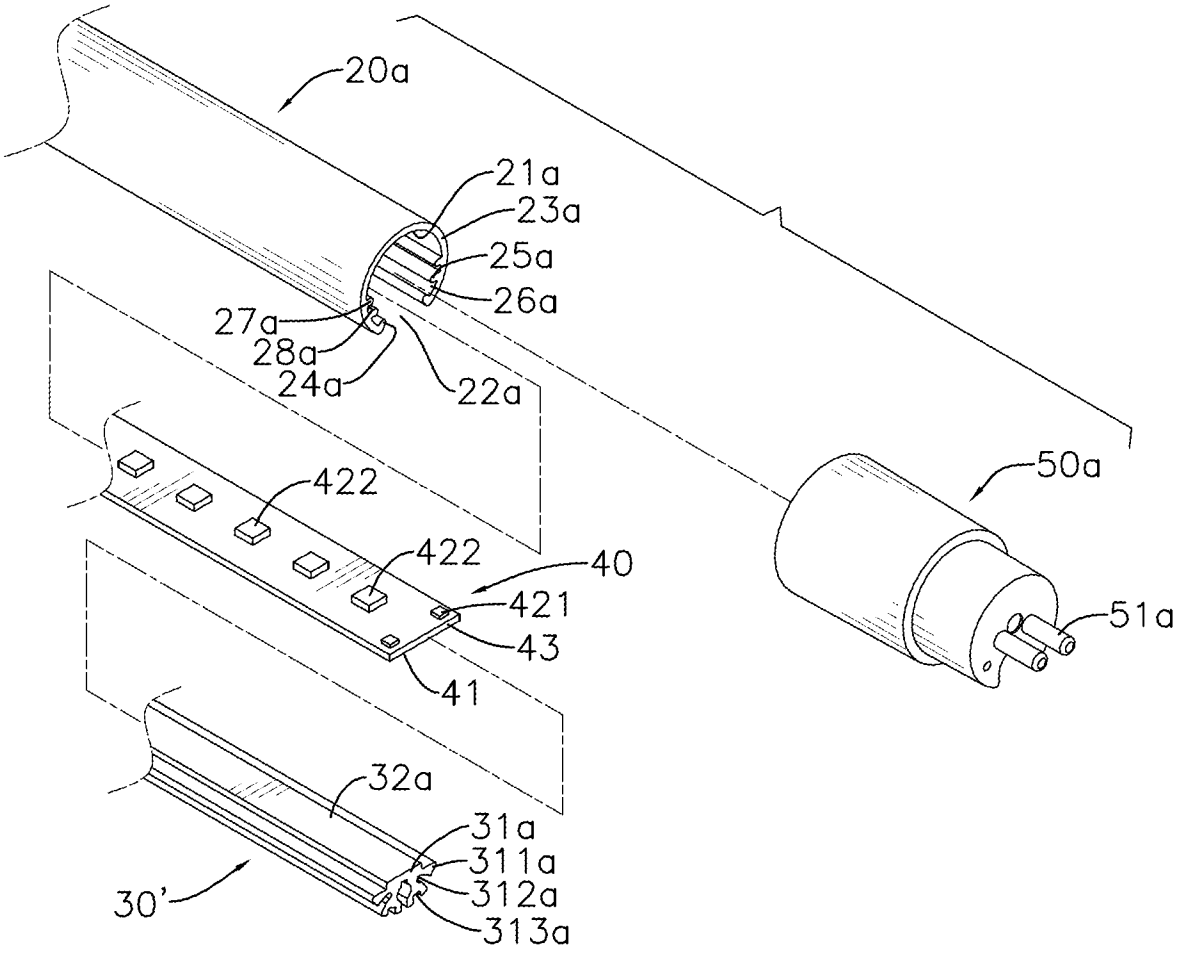
FIG. 7 is an exploded view of the LED tube in FIG. 6.
Figure 8:
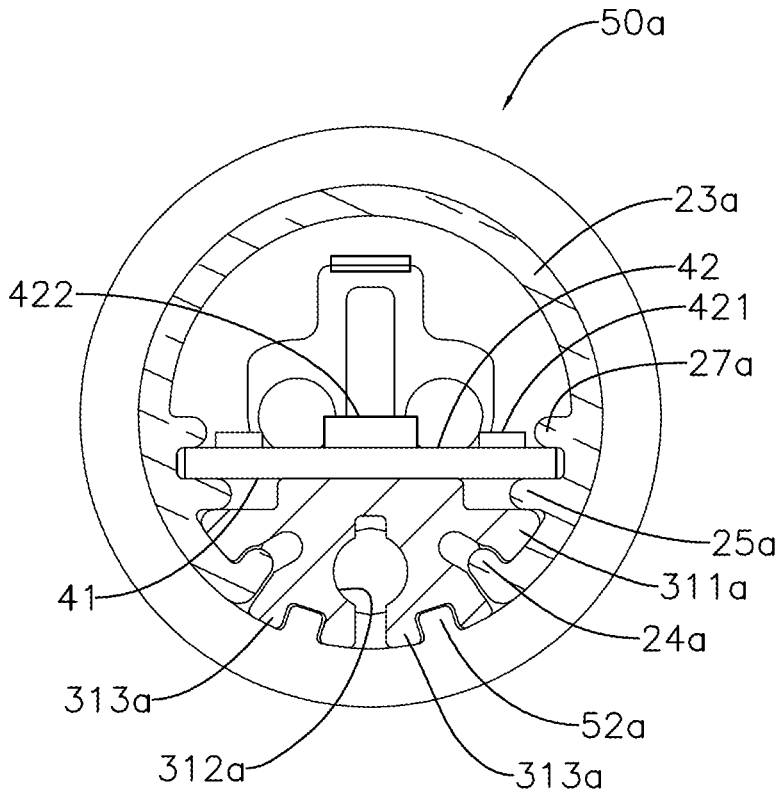
FIG. 8 is a side view in cross section of the LED tube in FIG. 6.
Figure 9:
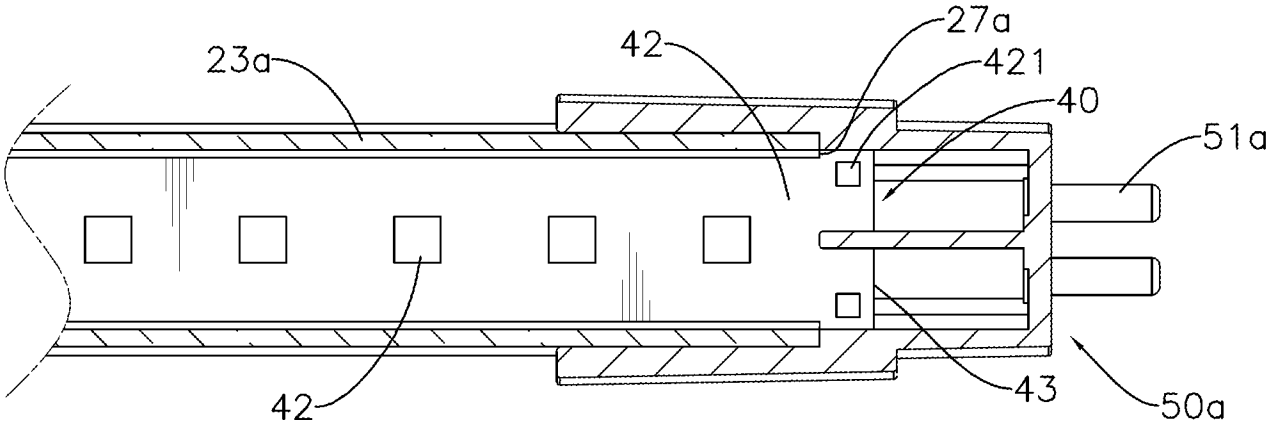
FIG. 9 is a top view in cross section of the LED tube in FIG. 6.
Figure 10:
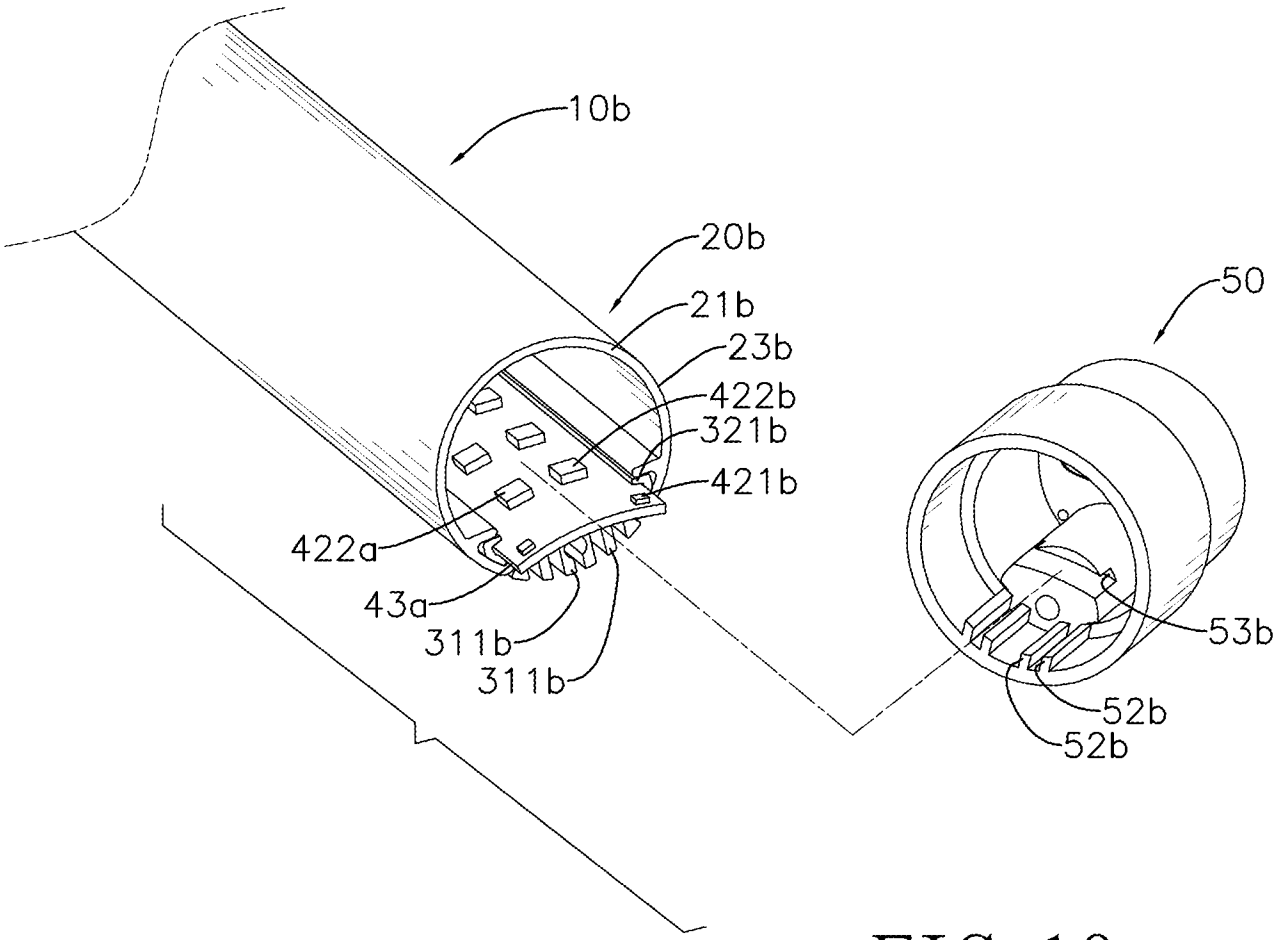
FIG. 10 is a partial exploded view of a third embodiment of an LED tube in accordance with the present invention.
Figure 11:
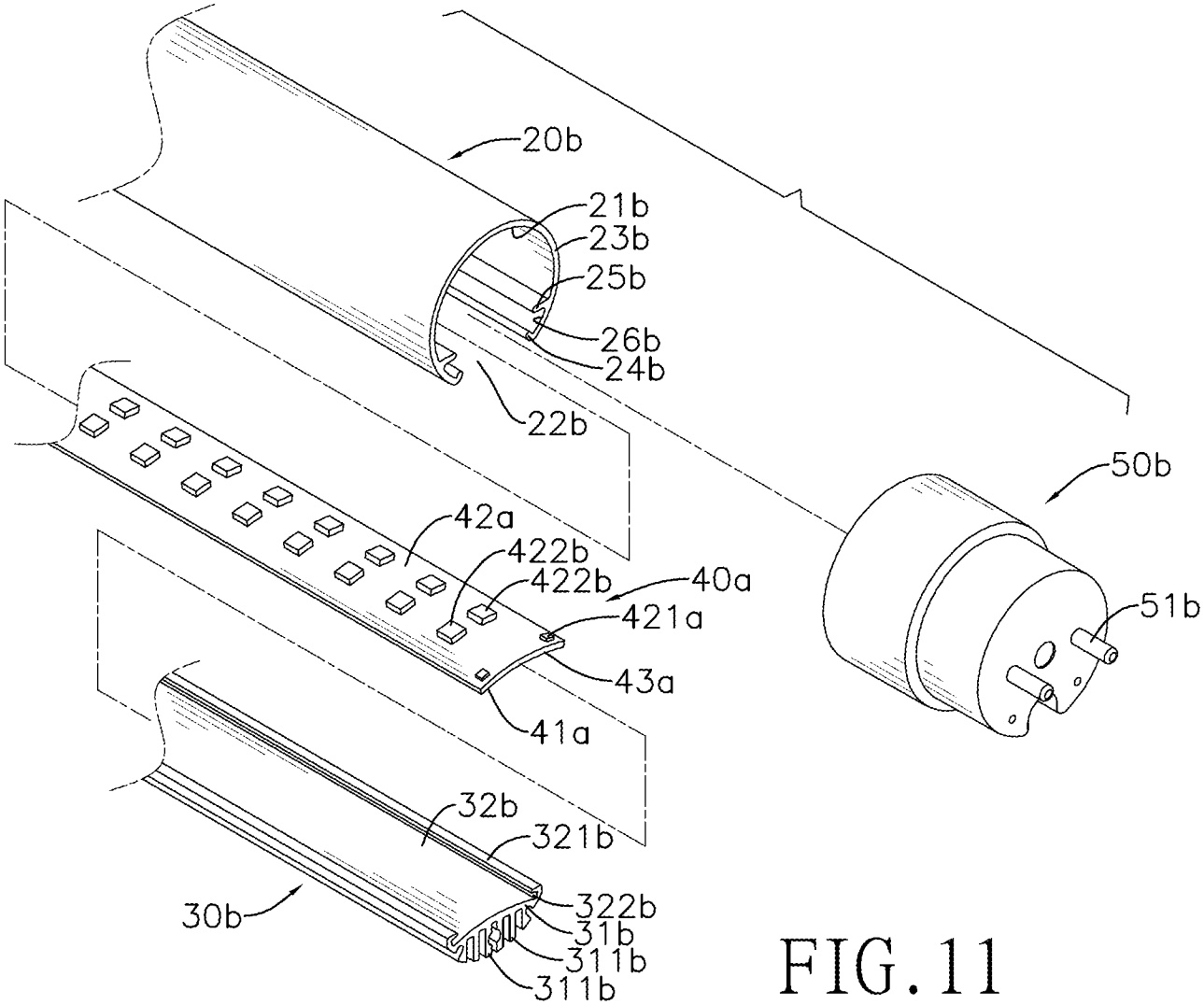
FIG. 11 is an exploded view of the LED tube in FIG. 10.
Figure 12:
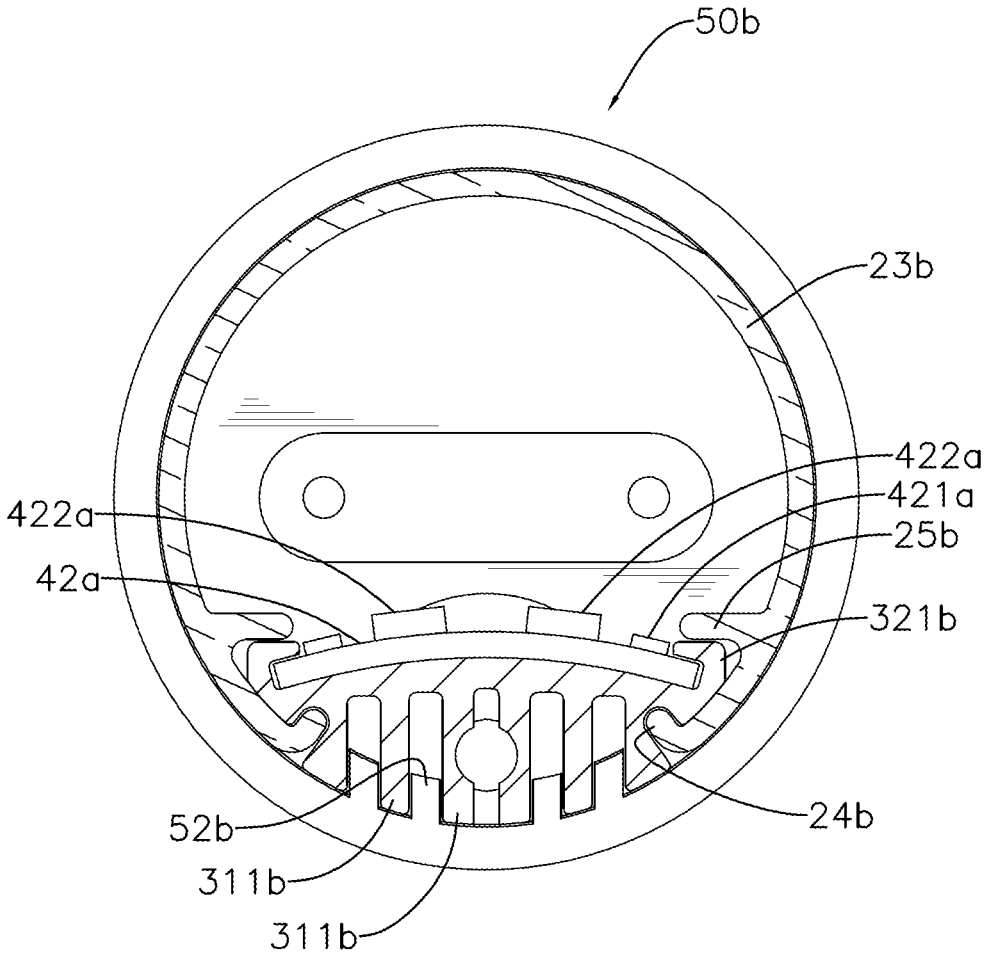
FIG. 12 is a side view in cross section of the LED tube in FIG. 10.
Figure 13:
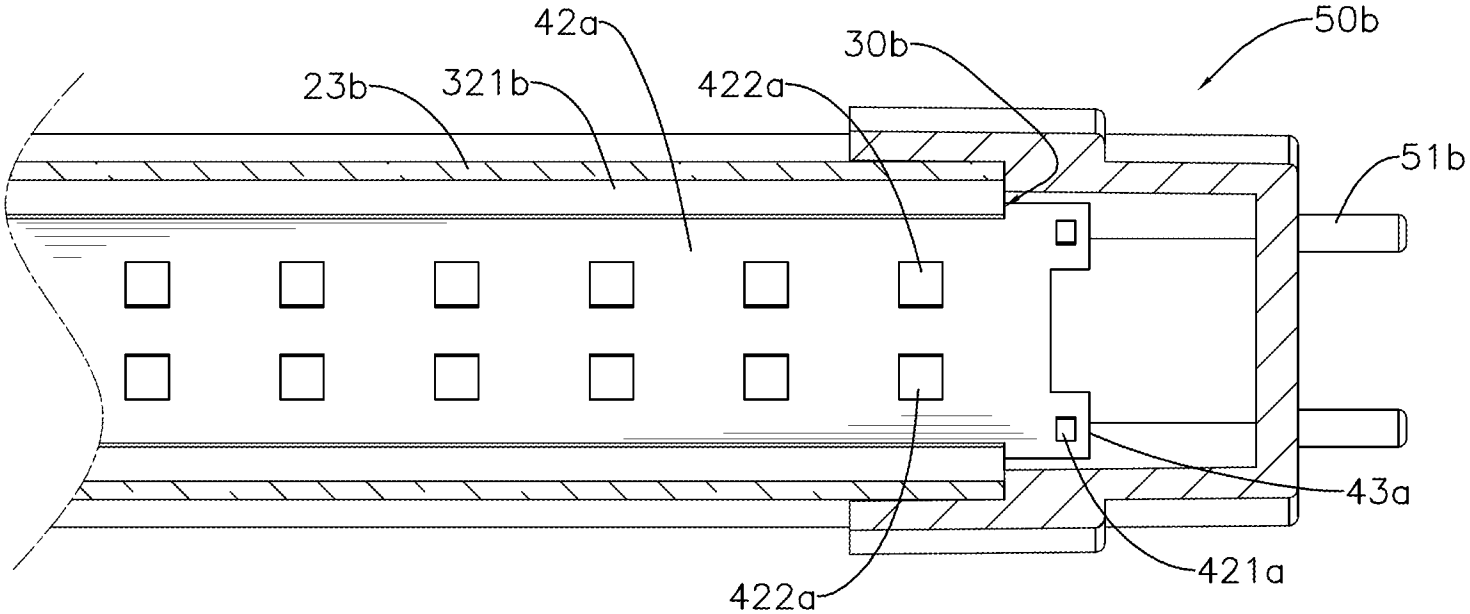
FIG. 13 is a top view in cross section of the LED tube in FIG. 10.
Figure 14:
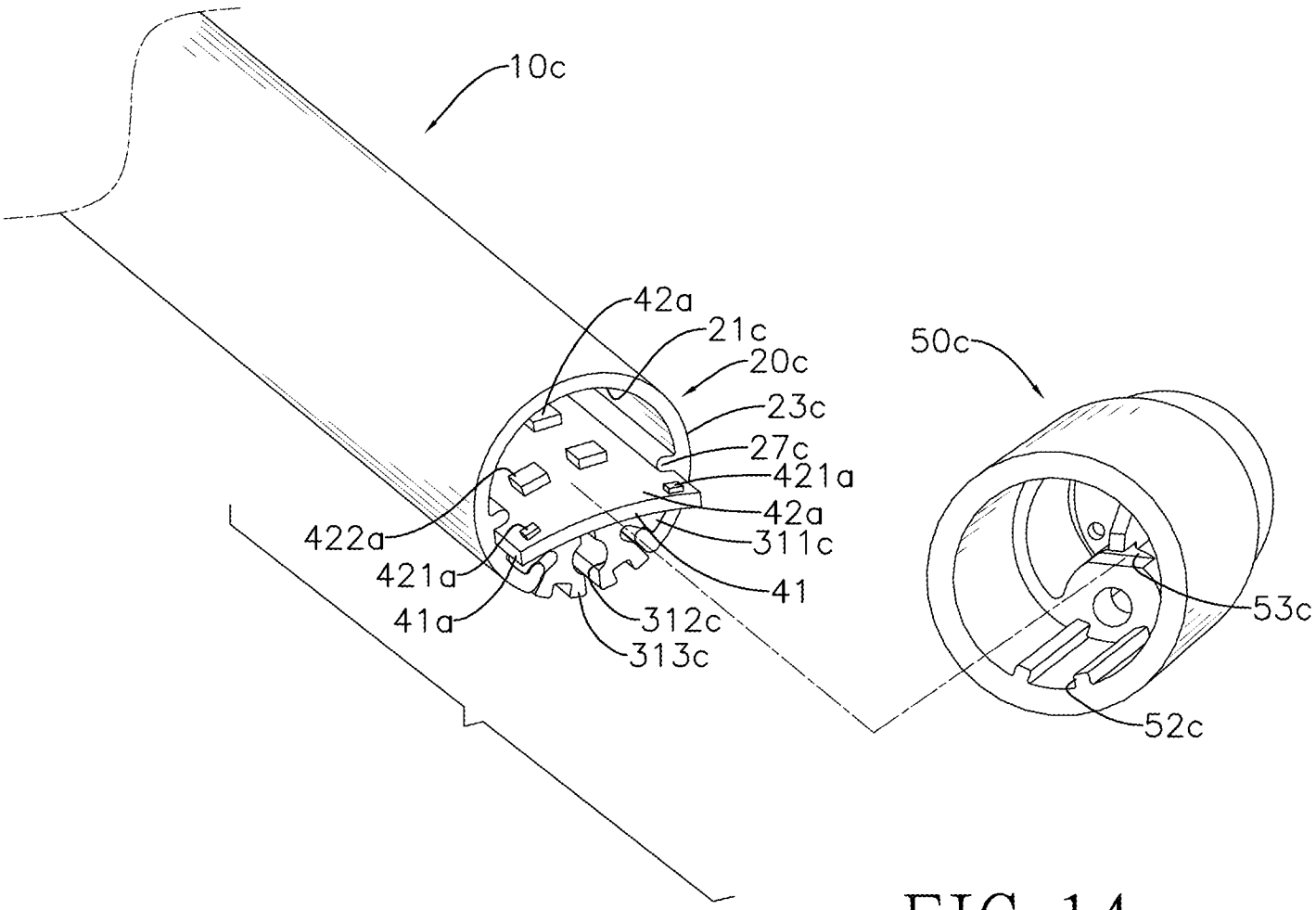
FIG. 14 is a partial exploded view of a fourth embodiment of an LED tube in accordance with the present invention.
Figure 15:
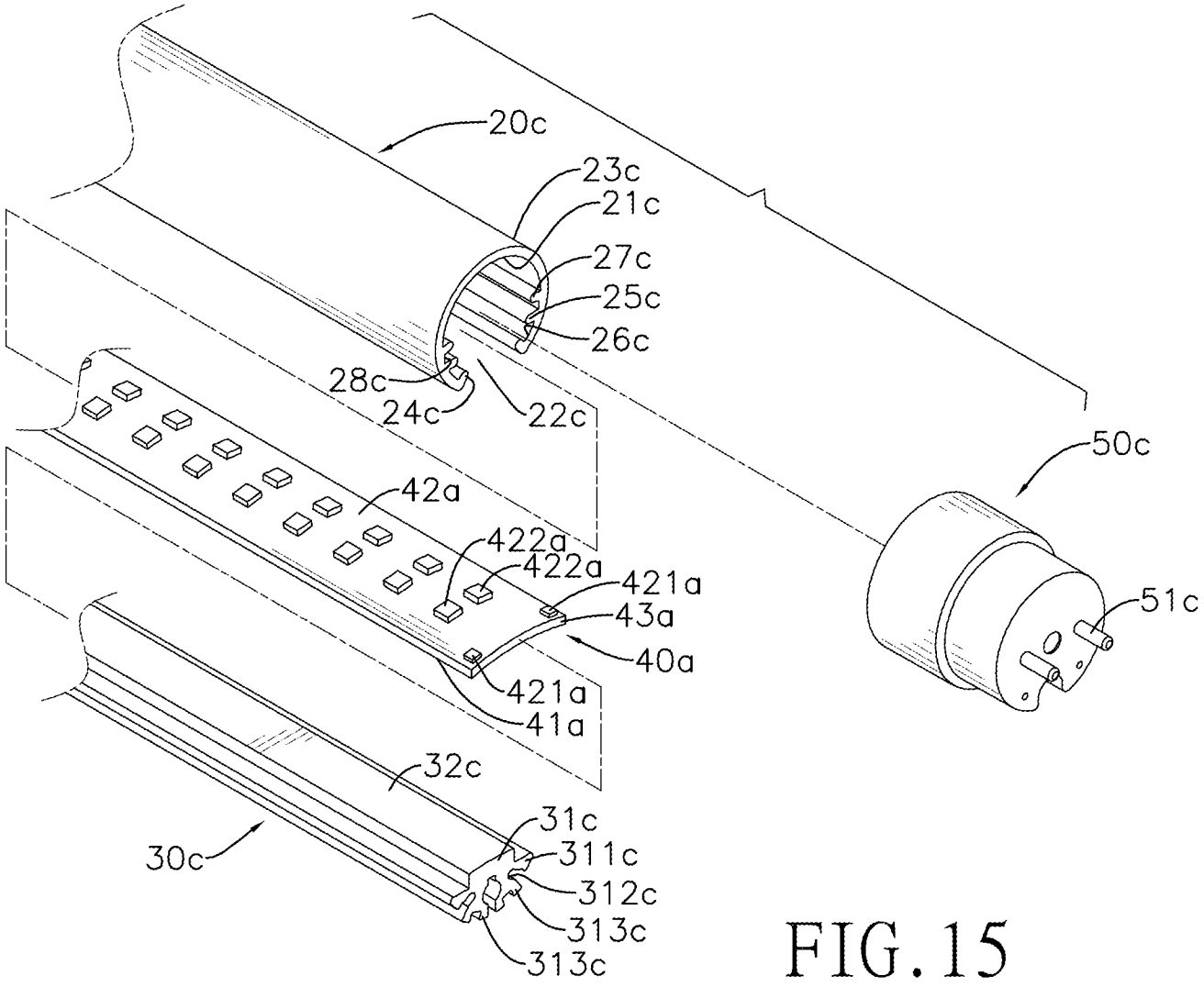
FIG. 15 is an exploded view of the LED tube in FIG. 14.
Figure 16:
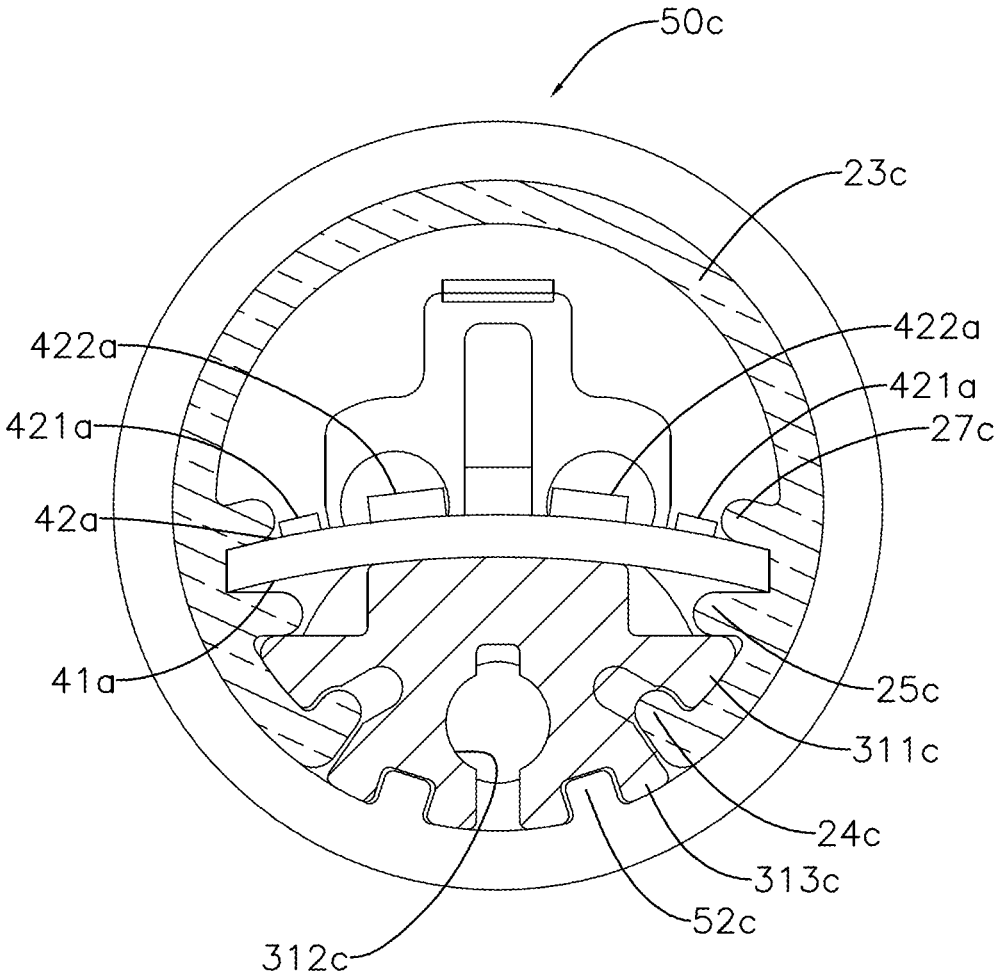
FIG. 16 is a side view in cross section of the LED tube in FIG. 14.
Figure 17:
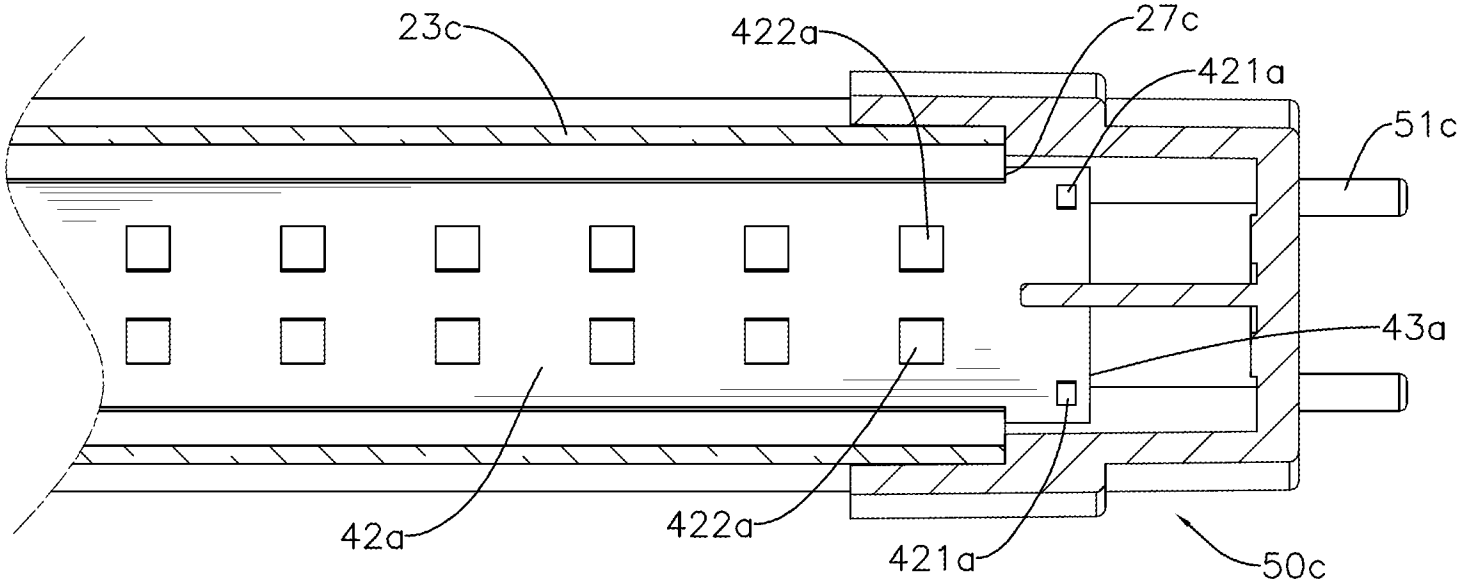
FIG. 17 is a top view in cross section of the LED tube in FIG. 14.
Figure 18:
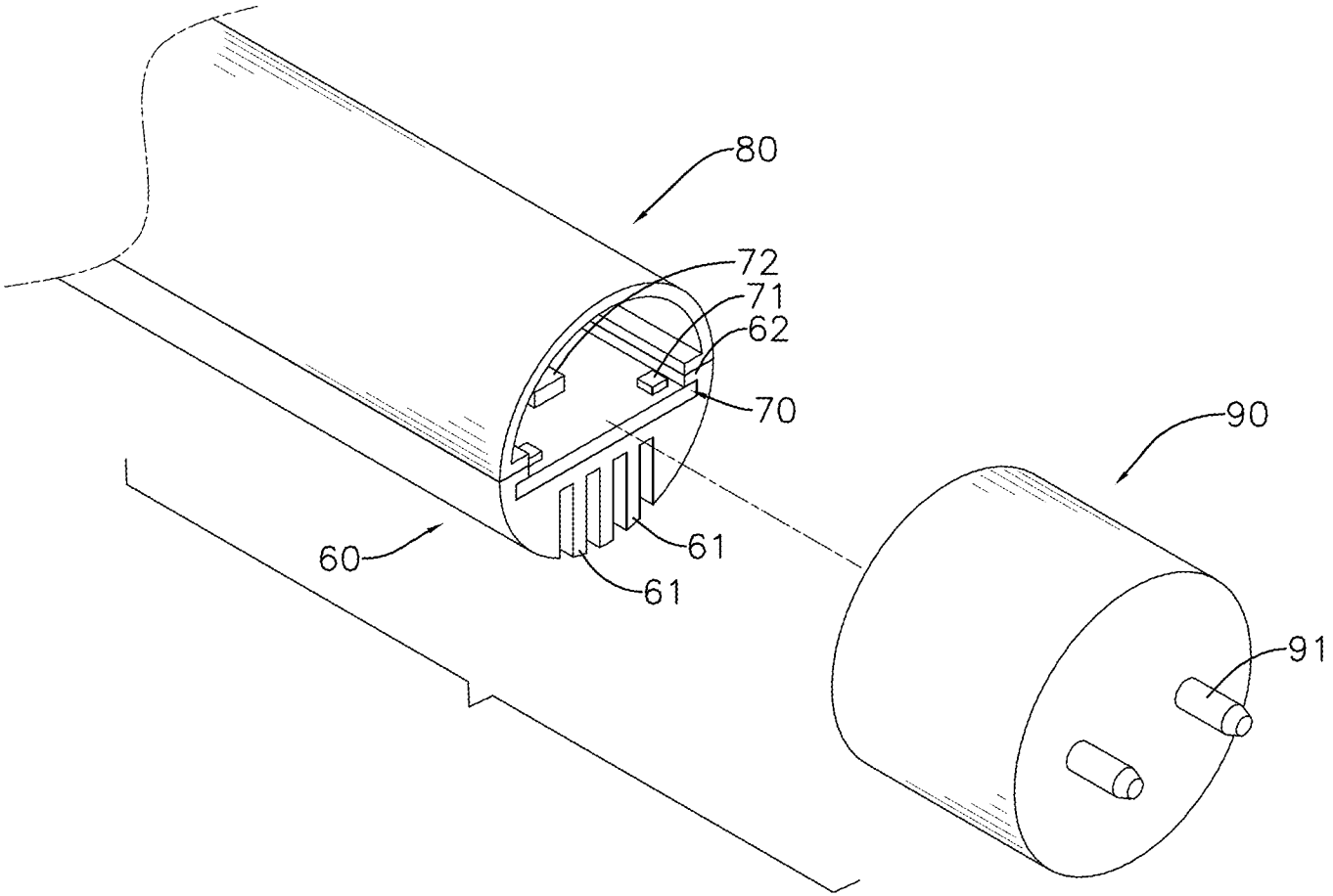
FIG. 18 PRIOR ART
FIG. 18 is a partial exploded view of a conventional LED tube.
Figure 19:
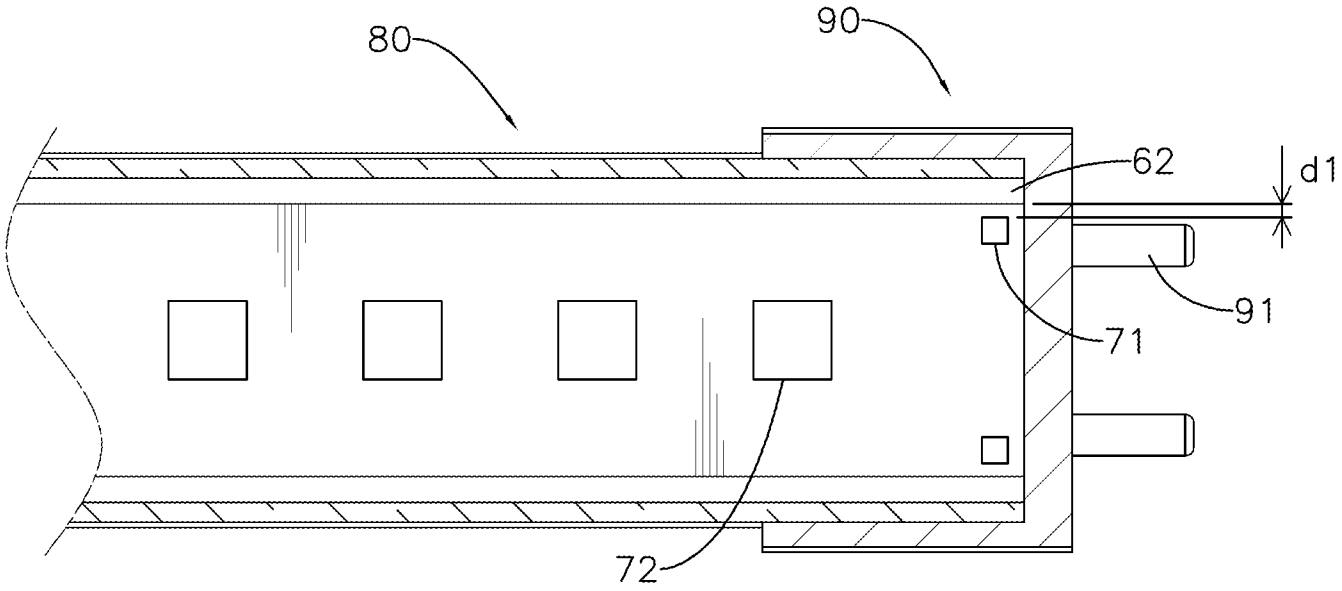
FIG. 19 PRIOR ART
FIG. 19 is a top view in cross section of the conventional LED tube in FIG. 18.

With reference to FIGS. 4 and 5, the length of the LED light board 40 in the longitudinal direction of the LED light board 40 is longer than the length of the heat dissipating seat 30 in the longitudinal direction of the heat dissipating seat 30. The two ends 43 of the LED light board 40 are respectively near the two openings 21 of the translucent tube shell 20 and extend out of the heat dissipating seat 30. Each two electrical connecting parts 421 are mounted near a corresponding one of the ends 43, that is, a creepage distance d2 between the electrical connecting part 421 and the slide bar 321 of the heat dissipating seat 30 is longer than a creepage distance d1 of the conventional LED tube. Furthermore, a creepage distance is defined between the electrical connecting part 421 and an end of the heat dissipating seat 30, wherein the creepage distance equals a sum of a distance d3 between the electrical connecting part 421 and an edge of the LED light board 40, a thickness d4 of the LED light board 40 and a distance d5 between the edge of the LED light board 40 and the heat dissipating seat 30. In conclusion, by mounting the electrical connecting parts 421 near the two opposite ends 43 of the lengthened LED light board 40, an internal creepage distance between the electrical connecting parts 421 and the heat dissipating seat 30 can be extended to improve electrical safety of the LED tube in accordance with the present invention.

With reference to FIGS. 6 to 9, a second embodiment of an LED tube in accordance with the present invention comprises a tube body 10*a*, an LED light board 40 and two caps 50*a*, wherein a structure of the LED light board 40 of the second embodiment is similar to that of the first embodiment. Therefore, description of the structure of the LED light board 40 will not be repeated in following paragraphs.

The tube body 10*a* comprises a translucent tube shell 20*a* and a heat dissipating seat 30*a*.

The translucent tube shell 20*a* is electrically insulating and has two openings 21*a*, a gap 22*a*, two side walls 23*a*, two first ribs 24*a*, two second ribs 25*a*, two first slide tracks 26*a*, two third ribs 27*a* and two second slide tracks 28*a*. The gap 22*a* is formed through the translucent tube shell 20*a* along a longitudinal direction of the translucent tube shell 20*a*. The two side walls 23*a* are separated by the gap 22*a*. The two first ribs 24*a* are respectively formed on the two side walls 23*a* and adjacent to the gap 22*a*. The two second ribs 25*a* are respectively formed on the two side walls 23*a*, and are respectively located above the two first ribs 24*a*. Each first slide track 26*a* is formed between a corresponding one of the side walls 23*a*, the first rib 24*a* formed on said corresponding side wall 23*a*, and the second rib 25*a* formed on said corresponding side wall 23*a*. The two third ribs 27*a* are respectively formed on the two side walls 23*a* and are respectively located above the two second ribs 25*a*. Each second slide track 28*a* is formed between a corresponding one of the side wall 23*a*, the second rib 25*a* formed on said corresponding side wall 23*a*, and the third rib 27*a* formed on said corresponding side wall 23*a*.

The heat dissipating seat 30*a* is mounted in the gap 22*a* of the translucent tube shell 20*a* and ais made of metal. The heat dissipating seat 30*a* has two opposite sides along a longitudinal direction of the heat dissipating seat 30*a*, a bottom surface 31*a* and a top surface 32*a* opposite to the bottom surface 31*a*. The bottom surface 31*a* faces downward and has two slide bars 311*a*, two fins 312*a* and two fork parts 313*a*. The two slide bars 311*a* extend from the bottom surface 31*a* and respectively along the two opposite sides of the heat dissipating seat 30*a*, wherein the two slide bars 311*a* are slidably mounted in the two first slide tracks 26*a* of the translucent tube shell 20*a* respectively. Each fin 312*a* extends downward from the bottom surface 31*a*. The two fork parts 313*a* are respectively formed on the two fins 312*a* to increase a radiating area of the two fins 312*a*.

In this embodiment, the two opposite sides of the LED light board 40 are slidably mounted in the two second slide tracks 28*a* of the translucent tube shell 20*a* respectively.

The caps 50*a* are respectively sleeved on the two openings 21*a* of the translucent tube shell 20*a*. Each cap 50*a* has an inner wall, two electrode pins 51*a* and two fin fixing parts 52*a*. The two electrode pins 51*a* are mounted through the cap 50*a* and are electrically connected to two corresponding ones of the electrical connecting parts 421 respectively. The two fin fixing parts 52*a* are formed on the inner wall of the cap 50*a* and respectively correspond in position to the two fork parts 313*a* of the two fins 312*a*.

According to the above description, the two opposite sides of the heat dissipating seat 30*a* are slidably mounted in the two first slide tracks 26*a* respectively and the two opposite sides of the LED light board 40 are slidably mounted in athe two second slide tracks 28*a* of the electrically insulating translucent tube shell 20*a* respectively, that is, the LED light board 40 is not mounted on the metal heat dissipating seat 30*a*. Only the back surface 41 of the LED light board 40 abuts the top surface 32 of the heat dissipating seat 30, and the luminous surface 42 is distal from the heat dissipating seat 30. Therefore, internal creepage distances of the LED tube in accordance with the present is further extended to improve the electrical safety of the LED tube in accordance with the present invention.

With reference to FIGS. 10 to 13, a third embodiment of an LED tube in accordance with the present invention comprises a tube body 10*b*, an LED light board 40*a* and two caps 50*b*.

The tube body 10*b* comprises a translucent tube shell 20*b* and a heat dissipating seat 30*b*.

The translucent tube shell 20*b* is electrically insulating and has two openings 21*b*, a gap 22*b* and two side walls 23*b*, two first ribs 24*b*, two second ribs 25*b* and two first slide tracks 26*b*. The gap 22*b* is formed through the translucent tube shell 20*b* along a longitudinal direction of the translucent tube shell 20*b*. The two side walls 23*b* are separated by the gap 22*b*. The two first ribs 24*b* are respectively formed on the two side walls 23*b* and adjacent to the gap 22*b*. The two second ribs 25*b* are respectively formed on the two side walls 23*b*, and are respectively located above the two first ribs 24*b*. Each first slide track 26*b* is formed between a corresponding one of the side walls 23*b*, the first rib 24*b* formed on said corresponding side wall 23*b*, and the second rib 25*b* formed on said corresponding side wall 23*b*.

The heat dissipating seat 30*b* is mounted in the gap 22*b* of the translucent tube shell 20*b* and bis made of metal. The heat dissipating seat 30*b* has two opposite sides in parallel to a longitudinal direction of the heat dissipating seat 30*b*, a bottom surface 31*b* and a top surface 32*b* opposite to the bottom surface 31*b*. The bottom surface 31*b* faces downward and has multiple fins 311*a* extending downward from the bottom surface 31*b*. The top surface 32*b* has two slide bars 321*b* and two slide tracks 322*b*. The two slide bars 321*b* extend upward from the top surface 32*b* and respectively along the two opposite sides of the heat dissipating seat 30*b*, wherein the two slide tracks 322*b* are respectively formed concave on the two slide bars 321*b* and face each other. In this embodiment, the top surface 32*b* is convex toward the translucent tube shell 20*b*.

The LED light board 40*a* is mounted in the tube body 10*a* and has two opposite sides slidably mounted in the two slide tracks 322*b* respectively, two opposite ends 43*a* connected to the two opposite sides of the LED light board 40*a*, a back surface 41*a*, and a luminous surface 42*a* opposite to the back surface 41*a*. The two ends 43*a* are respectively near the two openings 21*b* of the translucent tube shell 20*b*. The back surface 41*a* abuts the top surface 32*b* of the heat dissipating seat 30*b*. The luminous surface 42*a* has four electrical connecting parts 421*a* and multiple LED units 422*a*. Each two electrical connecting parts 421*a* are mounted on the luminous surface 42*a* and near a corresponding one of the ends 43*a*. In this embodiment, the back surface 41*a* is concave and corresponds in curvature to the convex top surface 32*b* of the heat dissipating seat 30*b*. The multiple LED units 422*a* are mounted on the luminous surface 42*a* and arranged in two lines, wherein the two lines of the LED units 422*a* are mounted on two beveled faces separated by a midline on the luminous surface 42*a*.

The caps 50*b* are respectively sleeved on the two openings 21*b* of the translucent tube shell 20*b*. Each cap 50*b* has an inner wall, two electrode pins 51*b*, multiple fin fixing parts

52*b* and a board fixing groove 53*b*. The two electrode pins 51*b* are mounted through the cap 50*b* and electrically connected to two corresponding ones of the electrical connecting parts 421*a* respectively. The multiple fin fixing parts 52*b* are formed on the inner wall of the cap 50*b*, wherein each fin fixing part 52*b* is mounted between two adjacent fins 311*b* of the multiple fins 311*b*. In this embodiment, the board fixing groove 53*a* is formed in the cap 50*b* is curved upward to correspond in curvature to a corresponding one of the ends 43*a* of the LED light board 40*a*.

In conclusion, the multiple LED units 422*a* mounted on the luminous surface 42*a* obliquely face the translucent tube shell 20*b* and increase an illumination range of the luminous surface 42*a*. An illumination angle of the LED tube in accordance with the present invention is also increased. Therefore, the LED tube glows evenly.

With reference to FIGS. 14 to 17, a fourth embodiment of an LED tube in accordance with the present invention comprises a tube body 10*c*, an LED light board 40*a* and two caps 50*c*. A structure of the LED light board 40*a* of the fourth embodiment is similar to that of the third embodiment. Therefore, the description of the structure of the LED light board 40*a* will not be repeated in following paragraphs.

The tube body 10*c* comprises a translucent tube shell 20*c* and a heat dissipating seat 30*c*.

The translucent tube shell 20*c* is electrically insulating and has two openings 21*c*, a gap 22*c*, two side walls 23*c*, two first ribs 24*c*, two second ribs 25*c*, two second slide tracks 26*c*, two third ribs 27*c* and two first slide tracks 28*c*. The gap 22*c* is formed through the translucent tube shell 20*c* along a longitudinal direction of the translucent tube shell 20*c*. The two side walls 23*c* are separated by the gap 22*c*. The two first ribs 24*c* are respectively formed on the two side walls 23*c* and adjacent to the gap 22*c*. The two second ribs 25*c* are respectively formed on the two side walls 23*c*, and are respectively located above the two first ribs 24*c*. Each first slide track 26*c* is formed between a corresponding one of the side walls 23*c*, the first rib 24*c* formed on said corresponding side wall 23*c*, and the second rib 25*c* formed on said corresponding side wall 23*c*. The two third ribs 27*c* are respectively formed on the two side walls 23*c* and respectively located above the two second ribs 25*c*. Each second slide track 28*c* is formed between a corresponding one of the side walls 23*c*, the second rib 25*c* formed on said corresponding side wall 23*c*, and the third rib 27*a* formed on said corresponding side wall 23*c*.

The heat dissipating seat 30*c* is mounted in the gap 22*c* of the translucent tube shell 20*c* and cis made of metal. The heat dissipating seat 30*c* has two opposite sides along a longitudinal direction of the heat dissipating seat 30*c*, a bottom surface 31*c* and a top surface 32*c* opposite the bottom surface 31*c*. The bottom surface 31*c* faces downward and has two slide bars 311*c*, two fins 312*c* and two fork parts 313*c*. The two slide bars 311*c* extend from the bottom surface 31*c* and respectively along the two opposite sides of the heat dissipating seat 30*c*, wherein the two slide bars 311*c* are slidably mounted in the two first slide tracks 26*c* of the translucent tube shell 20*c* respectively. Each fin 312*c* extends downward from the bottom surface 31*c*. The two fork parts 313*c* are respectively formed on the two fins 312*c* to increase a radiating area of the two fins 312*c*. In this embodiment, the top surface 32*c* is convex toward the translucent tube shell 20*c*.

In the fourth embodiment, the two opposite sides of the LED light board 40*a* are slidably mounted in the two second slide tracks 28*c* of the translucent tube shell 20*c* respectively.

The caps 50*c* are respectively sleeved on the two openings 21*c* of the translucent tube shell 20*c*. Each cap 50*c* has an inner wall, two electrode pins 51*c*, two fin fixing parts 52*c* and a board fixing groove 53*c*. The two electrode pins 51*c* are mounted through the cap 50*c* and are electrically connected to two of the corresponding electrical connecting parts 421*a* respectively. The two fin fixing parts 52*c* are formed on the inner wall and respectively correspond in position to the two fork parts 313*a* of the two fins 312*a*. In this embodiment, the board fixing groove 53*c* is curved upward to correspond in curvature to the convex LED light board 40*a*, wherein each end 43*a* of the LED light board 40*a* is mounted in a corresponding one of the board fixing grooves 53*c*.

According to the above description, the fourth embodiment of the LED tube in accordance with the present invention has advantages of the first, the second and the third embodiments. The two opposite sides of the heat dissipating seat 30*c* are slidably mounted in the two first slide tracks 26*c* respectively and the two opposite sides of the LED light board 40*a* are slidably mounted in the two second slide tracks 28*c* of the electrically insulating translucent tube shell 20*c* respectively to avoid a short-circuit between the heat dissipating seat 30*c* and the LED light board 40*a*. The two opposite ends 43*a* of the LED light board 40*a* extends out of the heat dissipating seat 30*a* to further extend distances between the electrical connecting parts 421*a* mounted on the ends 43*a* and the heat dissipating seat 30*c*. The two lines of the multiple LED units 422*a* obliquely face the translucent tube shell 20*c* and increase an illumination angle of the LED tube in accordance with the present invention.

Above all, each of the lengths of the LED light boards 40, 40*a* in the longitudinal direction of the LED light boards 40, 40*a* is longer than each of the lengths of the heat dissipating seat 30, 30*a* in the longitudinal direction of the heat dissipating seat 30, 30*a*, 30*b*, 30*c*. The two ends 43, 43*a* extend out of the heat dissipating seat 30, 30*a*, 30*b*, 30*c*. Each two electrical connecting parts 421, 421*a* are mounted near a corresponding one of the ends 43, 43*a*, that is, by mounting the electrical connecting parts 421, 421*a* near the two opposite ends 43, 43*a* of the lengthened LED light board 40, 40*a*, an internal creepage distance between the electrical connecting parts 421, 421*a* and the heat dissipating seat 30, 30*a*, 30*b*, 30*c* can be extended to improve electrical safety of the LED tube in accordance with the present invention.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An LED tube having long internal creepage distances comprising:

a tube body having:

a translucent tube shell having two openings;

a gap formed through the translucent tube shell along a longitudinal direction of the translucent tube shell;

two side walls separated by the gap; and a heat dissipating seat mounted in the gap;

an LED light board mounted in the tube body, wherein a length of the LED light board in a longitudinal direction of the LED light board is longer than a length of the heat dissipating seat in a longitudinal direction of the heat dissipating seat, and the LED light board having:

two opposite sides;

two opposite ends connected to the two sides of the LED light board and respectively near the two openings of the translucent tube shell, wherein the two opposite ends extend out of the heat dissipating seat;

a back surface abutting the heat dissipating seat; and a luminous surface opposite to the back surface and facing toward the translucent tube shell, wherein the luminous surface has four electrical connecting parts mounted on the luminous surface, wherein each one of the two opposite ends of the LED light board has two of the four electrical connecting parts; and two caps respectively mounted on the two openings of the translucent tube shell, wherein each cap has two electrode pins electrically and respectively connected to a corresponding one of the electrical connecting parts of the LED light board.

2. The LED tube as claimed in claim 1, wherein the translucent tube shell further comprises two first slide tracks respectively formed on the two side walls; and the heat dissipating seat further has two opposite sides slidably mounted in the two first slide tracks of the translucent tube shell respectively.

3. The LED tube as claimed in claim 2, wherein the heat dissipating seat further comprises a bottom surface facing downward and having multiple fins extending downward from the bottom surface;

a top surface opposite to the bottom surface and having two slide bars extending upward from the top surface and respectively along the two opposite sides of the heat dissipating seat, wherein the two slide bars are slidably mounted in the two first slide tracks of the translucent tube shell respectively; and two slide tracks respectively formed on the two slide bars, wherein the two slide tracks face each other; and wherein the opposite sides of the LED light board are slidably mounted in the two slide tracks of the heat dissipating seat respectively.

4. The LED tube as claimed in claim 2, wherein the translucent tube shell further comprises two first slide tracks respectively formed on the two side walls; and two second slide tracks respectively formed on the two side walls, wherein the two second slide tracks are respectively located above the two first slide tracks;

the two opposite sides of the heat dissipating seat are further slidably mounted in the two first slide tracks of the translucent tube shell respectively; and the two opposite sides of the LED light board are slidably mounted in the two second slide tracks of the translucent tube shell respectively.

5. The LED tube as claimed in claim 3, wherein the top surface of the heat dissipating seat is convex toward the translucent tube shell;

the back surface of the LED light board is concave and corresponds in curvature to the top surface of the heat dissipating seat; and the luminous surface of the LED light board is convex toward the translucent tube shell.

6. The LED tube as claimed in claim 3, wherein each cap has multiple fin fixing parts formed in the cap and respectively corresponding in position to two adjacent fins of the multiple fins of the heat dissipating seat.

7. The LED tube as claimed in claim 3, wherein each fin of the heat dissipating seat has a fork part formed on the fin; and each cap has multiple fin fixing parts formed in the cap and respectively corresponding in position to the multiple fork parts of the heat dissipating seat.

8. The LED tube as claimed in claim 1, wherein each cap further comprises a board fixing groove formed in the cap, wherein the board fixing groove corresponds in position to a corresponding one of the ends of the LED light board.

9. The LED tube as claimed in claim 4, wherein each cap further comprises a board fixing groove formed in the cap, wherein the board fixing groove corresponds in position to a corresponding one of the ends of the LED light board.

10. The LED tube as claimed in claim 8, wherein each cap further comprises a board fixing groove formed in the cap, wherein the board fixing groove corresponds in position to a corresponding one of the ends of the LED light board.

11. The LED tube as claimed in claim 5, wherein each cap further comprises a board fixing groove formed in the cap, wherein the board fixing groove is curved upwards and corresponds in curvature to a corresponding one of the ends of the LED light board.

12. The LED tube as claimed in claim 1, wherein the LED light board further comprises multiple LED units mounted at intervals on the luminous surface along the longitudinal direction of the LED light board.

13. The LED tube as claimed in claim 4, wherein the LED light board further comprises multiple LED units mounted at intervals on the luminous surface along the longitudinal direction of the LED light board.

14. The LED tube as claimed in claim 5, wherein the luminous surface of the LED light board further comprises a midline along a longitudinal direction of the luminous surface;

two beveled faces separated by the midline; and multiple LED units arranged in two lines, wherein the two lines of the multiple LED units are respectively mounted on the two beveled faces and along the longitudinal direction of the luminous surface.

15. The LED tube as claimed in claim 3 wherein the heat dissipating seat further comprises two semi-annular grooves respectively formed on two adjacent fins of the multiple fins, wherein the two semi-annular grooves face each other; and each cap further comprises a screw having a screw rod mounted through the cap and between the two semi-annular grooves of the heat dissipating seat; and a screw head connected to the screw rod and abutting the cap.

16. The LED tube as claimed in claim 7 wherein the heat dissipating seat further comprises two semi-annular grooves respectively formed on two adjacent fins of the multiple fins, wherein the two semi-annular grooves face each other; and each cap further comprises a screw having a screw rod mounted through the cap and between the two semi-annular grooves of the heat dissipating seat; and a screw head connected to the screw rod and abutting the cap.

* * * * *